US005921035A

United States Patent [19]

Kempf

[11] Patent Number: 5,921,035

[45] Date of Patent: Jul. 13, 1999

[54] LOCKABLE SCREW POST APPARATUS

[76] Inventor: Brian J. Kempf, 615 E. 11th, Davis, Calif. 95616

[21] Appl. No.: 08/741,394

[22] Filed: Oct. 29, 1996

[51] Int. Cl.[6] ..... E02D 5/74

[52] U.S. Cl. ..... 52/157; 70/58; 248/545; 52/165

[58] Field of Search ..... 52/156, 157, 165, 52/155; 248/156, 545; 70/14, 58

[56] References Cited

U.S. PATENT DOCUMENTS

| | | | |
|---|---|---|---|
| 571,624 | 11/1896 | Ryan . | |
| 818,061 | 4/1906 | Toy et al. . | |
| 903,686 | 11/1908 | Devany | 52/158 |
| 906,438 | 12/1908 | Lemerand . | |
| 2,168,830 | 8/1939 | Schroth | 135/98 X |
| 2,234,907 | 3/1941 | Williams . | |
| 2,901,789 | 9/1959 | Frank | 52/165 |
| 4,120,125 | 10/1978 | Cvetan | 52/156 |
| 4,242,822 | 1/1981 | Black | 248/156 X |
| 4,343,449 | 8/1982 | Osthus | 248/156 |
| 4,402,166 | 9/1983 | Wortham | 248/156 X |
| 4,441,679 | 4/1984 | Calet | 248/156 |
| 4,471,588 | 9/1984 | Schirm | 52/165 X |
| 4,483,506 | 11/1984 | Litwiller | 248/156 X |
| 4,543,972 | 10/1985 | Bennett et al. . | |
| 4,593,872 | 6/1986 | Svensson | 52/157 X |
| 4,803,812 | 2/1989 | Alexander | 52/157 |
| 4,850,564 | 7/1989 | Padin . | |
| 4,858,876 | 8/1989 | Moreno . | |
| 4,910,902 | 3/1990 | Anderson | 248/156 X |
| 5,046,699 | 9/1991 | Perreault | 52/157 |
| 5,065,975 | 11/1991 | Giles | 248/156 X |
| 5,113,627 | 5/1992 | Jarrett | 52/157 |
| 5,123,623 | 6/1992 | McNamara | 248/156 X |
| 5,135,192 | 8/1992 | Winkler . | |
| 5,139,235 | 8/1992 | Kilmer | 52/157 X |
| 5,152,495 | 10/1992 | Jacinto et al. . | |
| 5,156,369 | 10/1992 | Tizzoni . | |
| 5,181,335 | 1/1993 | Todd | 248/156 X |
| 5,358,209 | 10/1994 | Ward . | |
| 5,457,918 | 10/1995 | Plourde | 52/165 |
| 5,482,246 | 1/1996 | Derkoski . | |
| 5,501,086 | 3/1996 | Sherlock | 52/157 X |
| 5,575,122 | 11/1996 | Hamilton | 52/157 |
| 5,697,600 | 12/1997 | Fingerson et al. | 52/157 X |

*Primary Examiner*—Beth A. Aubrey

*Attorney, Agent, or Firm*—Michael L. Louie; Beyer & Weaver, LLP

[57] ABSTRACT

An anchoring device for anchoring a shaft in relatively hard ground including an elongated shaft having a ground penetration member. The penetration member includes a coiled extension portion extending longitudinally beyond the shaft lower end to facilitate penetration of the ground when rotated in one direction. The coiled length of the extension portion is sufficiently short to resist substantial uncoiling of the coiled extension portion during penetrating movement into the relatively hard ground. In another aspect, a retaining device is provided for selective penetration of the ground at a second location spaced-apart from the first location to substantially prevent rotational movement of the shaft about the longitudinal axis for removal thereof from the ground.

53 Claims, 3 Drawing Sheets

LOCKABLE SCREW POST APPARATUS

BACKGROUND-FIELD OF INVENTION

The present invention relates, generally, to ground anchoring devices and, more particularly, to screw post apparatus are screwed into the ground.

BACKGROUND-DESCRIPTION OF PRIOR ART

There have been numerous attempts to provide anchoring apparatus for anchoring objects into the ground in a secure manner. U.S. Pat. No. 906,438 to Lemerand, for example, discloses an anchoring device for a portable hitching post. The anchoring device includes a screw mechanism attached to a lower end which can be rotationally driven into the ground for the purpose of securing a horse.

U.S. Pat. No. 818,061 to Toy, Jr., et al. discloses an auger-like land anchor comprising a helical upwardly angled disk.

U.S. Pat. No. 5,046,699 to Perreault et al., additionally, for example, discloses an anchoring device for an umbrella post. The anchoring device includes a screw mechanism attached to a lower end of the umbrella post. The screw mechanism can be rotationally driven into the ground for the purpose of securing the umbrella in place. Similar devices are disclosed in U.S. Pat. Nos. 5,156,369 to Tizzoni, 4,850,564 to Paden, 5,482,246 to Kerkoski, and 5,358,209 to Ward.

U.S. Pat. No. 4,858,876 to Moreno discloses a post and ground support utilizing a helical mechanism which defines an auger for digging the ground support into the earth. U.S. Pat. Nos. 2,234,907 to Williams and 571,624 to Ryan each disclose a screw anchor. U.S. Pat. No. 5,135,192 to Winkler discloses a ground anchor comprising a flat plate and helical rod extending at a right angle from one surface of the plate.

U.S. Pat. No. 4,543,972 to Bennett discloses a tent stake with lockable means revealing a pair of metal clamp plates, several Allen head screws, a pivotal covering plate, a ground stank and a padlock.

Although the foregoing devices may be generally effective in securing a post into loose dirt or sand, these devices provide less than adequate results when attempting to secure these posts in harder soils, such as compacted dirts, clays or the like. Hence, these above-mentioned devices are limit in operation to loose dirts and sand, and provide less than adequate results in preventing unwanted removal thereof from the ground. For instance, removal from the loose dirt or sand can be easily accomplished by simply unscrewing them. Operation costs are thus increased when these anchoring devices are stolen, vandalized or simply removed.

OBJECTS AND ADVANTAGES

Accordingly, it is an object of the present invention to provide an anchoring device which facilitates effective mounting into harder soils.

It is another object of the present invention to provide an anchoring device which discourages unauthorized removal from the ground.

Still another object of the present invention is to provide a screw-post device which can be locked to the ground.

It is a further object of the present invention to provide an anchoring device which is durable, compact, easy to maintain, has a minimum number of components, is easy to use by unskilled personnel, and is economical to manufacture.

The apparatus of the present invention has other objects and features of advantage which will be more readily apparent from the following description of the Detailed Description of the Preferred Embodiments of the Present Invention and the appended claims, when taken in conjunction with the accompanying drawings.

SUMMARY OF THE INVENTION

The present invention provides an anchoring device for anchoring a shaft in the ground including an elongated shaft having a lower end adapted for rotationally penetrating the ground at a first location of penetration thereof when rotated about a longitudinal axis of the shaft, and a retaining device releasably coupled to the shaft. The retaining device is formed and dimensioned for selective penetration of the ground at a second location spaced-apart from the first location to substantially prevent rotational movement of the shaft about the longitudinal axis for removal thereof from the ground.

In another aspect of the present invention, an anchoring device is provided for anchoring a shaft in relatively hard ground which includes an elongated shaft including a ground penetration member having a plurality of helical-shaped coils mounted to and spiraling about a shaft longitudinal axis at a lower end thereof. The penetration member includes a coiled extension portion extending longitudinally beyond the shaft lower end in a coiled manner and having a diameter substantially smaller than the diameter of the shaft. The extension portion further extends around the shaft and is in substantial axial alignment with the shaft longitudinal axis to facilitate penetration of the ground when rotated in one direction about the shaft longitudinal axis and is of a coiled length sufficiently short to resist substantial uncoiling of the coiled extension portion during penetrating movement into the relatively hard ground.

Accordingly, the present invention provides a screw-post device which is capable of locking to the ground to prevent unauthorized removal thereof, while further providing a screw-post device which facilitates installation and removal thereof in relatively hard soils, clays or the like.

REFERENCE NUMERAL IN DRAWINGS

Figure 1:
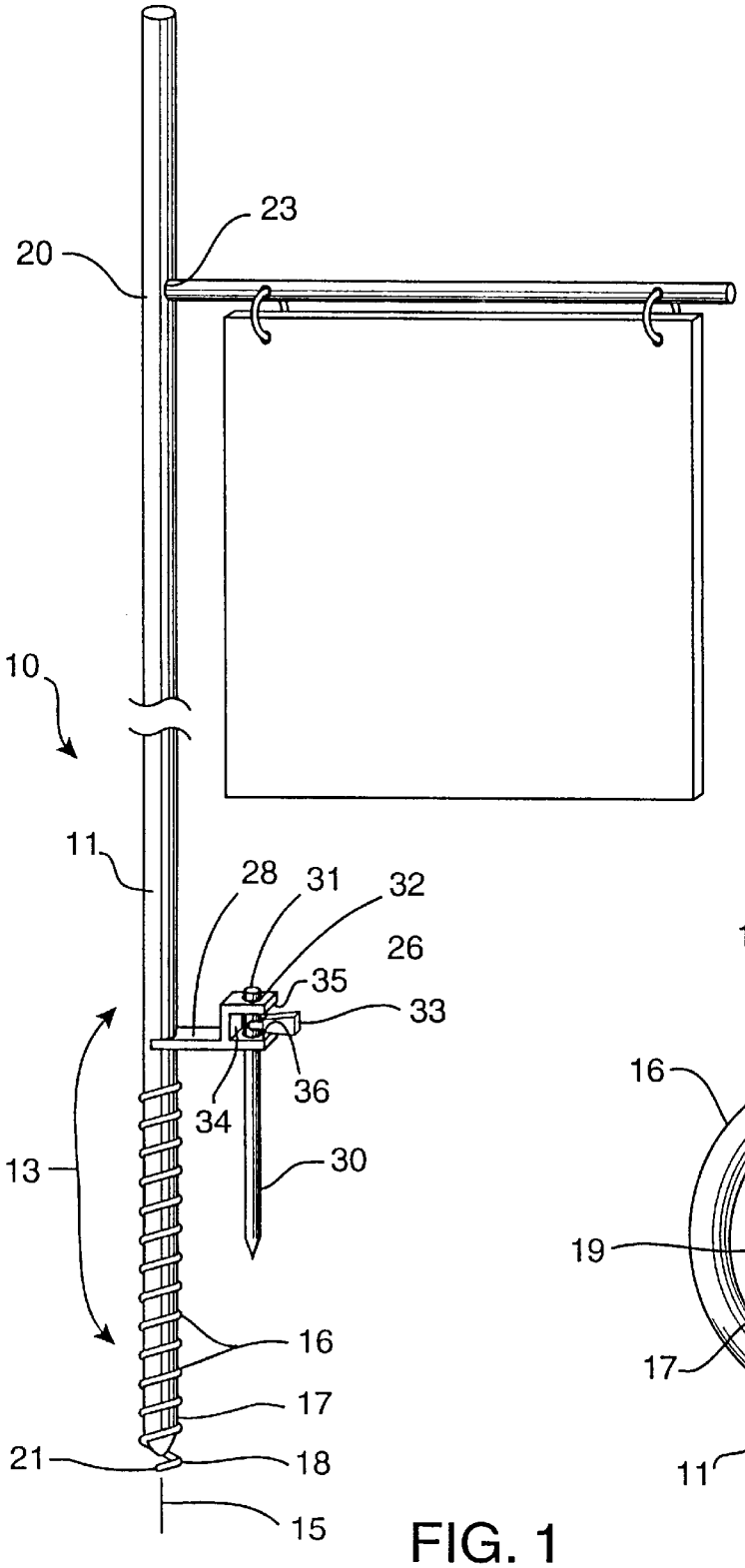
FIG. 1 is a fragmentary top perspective view of an anchoring device constructed in accordance with the present invention having an advertising sign supported thereon.

| | |
|---|---|
| 10 | anchoring device |
| 11 | shaft |
| 12 | ground |
| 13 | ground penetration member |
| 15 | shaft longitudinal axis |
| 16 | helical-shaped coils |
| 17 | lower end |
| 18 | coiled extension portion |
| 19 | opening |
| 20 | upper longitudinal end |
| 21 | penetrating tip portion |
| 22 | crank arm |
| 23 | slot |
| 24 | upper flange portion |
| 25 | first location |
| 26 | retaining device |
| 27 | second location |
| 28 | flange |
| 29 | lower flange portion |
| 30 | ground engaging member |
| 31 | head portion |
| 32 | flange bore |
| 33 | locking mechanism |
| 34 | channel |
| 35 | upper retaining surface |
| 36 | lower retaining surface |
| 37 | aperture |
| 38 | U-bolt |

DETAILED DESCRIPTION OF THE PREFERRED EMBODIMENTS

The following description is presented to enable a person skilled in the art to make and use the invention, and is provided in the context of a particular application and its requirements. Various modifications to the preferred embodiment will be readily apparent to those skilled in the art, and the generic principles defined herein may be applied to other embodiments and applications without departing from the spirit and scope of the invention. Thus, the present invention is not intended to be limited to the embodiment shown, but is to be accorded with the widest scope consistent with the principles and features disclosed herein. It will be noted here that for a better understanding, like components are designated by like reference numerals throughout the various figures.

Figure 2:
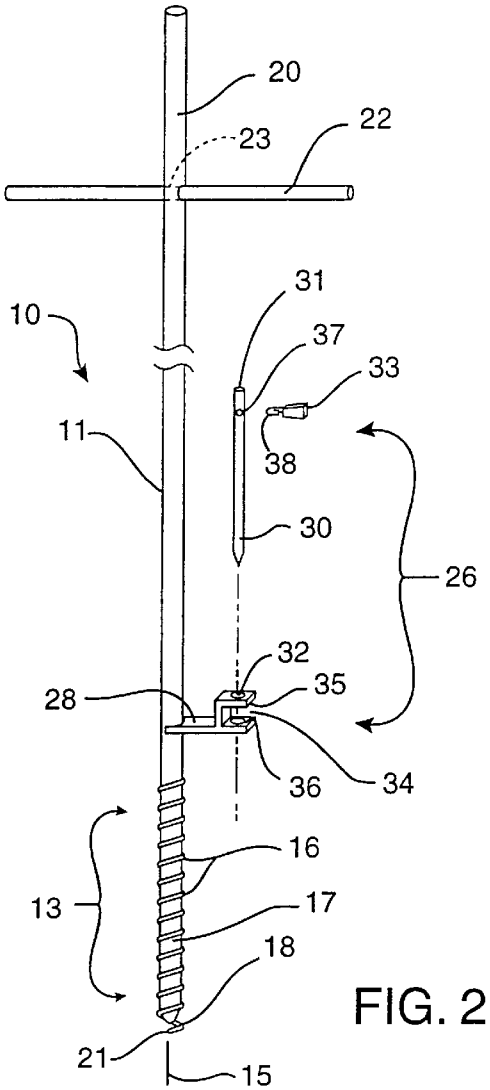
FIG. 2 is an exploded top perspective view of the anchoring device of FIG. 1.

Attention is now directed to FIGS. 1 and 2, where the subject anchoring device, generally designated 10, is provided for anchoring a shaft 11 in relatively hard ground 12. The anchoring device includes a ground penetration member 13 having a plurality of helical-shaped coils 16 mounted to and spiraling about a shaft longitudinal axis 15 at a lower end 17 thereof. The penetration member 13 includes a coiled extension portion, generally designated 18, extending longitudinally beyond the shaft lower end 17 in a coiled manner and having a diameter substantially smaller than the diameter of the shaft 11. The extension portion 18 extends around shaft 11 in substantial axial alignment (FIG. 3) with the shaft longitudinal axis 15 to facilitate penetration of the ground when rotated in one direction about the shaft longitudinal axis 15. Further, the extension portion 18 is of a coiled length sufficiently short to resist substantial uncoiling of the coiled extension portion during penetrating movement into the relatively hard ground 12.

Accordingly, the present invention provides an anchoring device including a coiled extension portion formed to facilitate rotational mounting thereof in relatively hard soils and clays. The extension portion has a substantially constant coil diameter which extends beyond the distal end of the anchoring device shaft by a predetermined coil length enabling penetration of hard soils without substantial uncoiling of the extension portion during penetrating operation. Upon initial penetration or threading into the ground by the extension portion in a cork-screw manner, the shaft is drawn into the ground through the pre-threaded extension portion. This arrangement provides a highly reliable, lightweight, yet economical device that easily screws and locks into the earth preventing unwanted removal of the device from the ground. In addition, the anchoring device is very versatile, reduces the time and labor involved when inserting a shaft into the ground, and is capable of penetrating hard soils while remaining efficient in operation.

The anchoring device 10 preferably includes a generally straight, tubular shaft 11, having an upper longitudinal end 20 and a lower longitudinal end 17, of the type typically employed for real-estate signs, rental signs, temporary or permanent fence posts, and tree, garden, landscape, volleyball, or badminton accessories or the like. The shaft is preferably constructed from metal, plastic or other generally rigid material, and may include a transverse cross-sectional dimension other than circular without departing from the true spirit and nature of the present invention. Further, the distal end of the lower end 17 of the shaft 11, as shown in FIG. 3, may include an opening 19 into the tubular shaft for receipt of soil therein during penetration.

In accordance with the present invention, the ground penetration member 13 is mounted to the shaft lower longitudinal end 17 in a manner spiraling about the shaft longitudinal axis 15. The penetration member 13 includes a plurality of helical-shaped coils 16 protruding radially outward from the circumferential surface of the lower longitudinal end 17 to form coils or threaded portion 16. This threaded portion 16 in combination with the extension portion 18, to be discussed below, facilitate threading thereof into compacted soils. The thread profile is preferably rounded, although a more conventional thread profile may be incorporated which converges to an edge thereof. Moreover, the pitch of the threaded portion 16 is preferably based on a number of conventional factors including the hardness of the soil, the diameter of the shaft and the profile of the threads.

Figure 3:
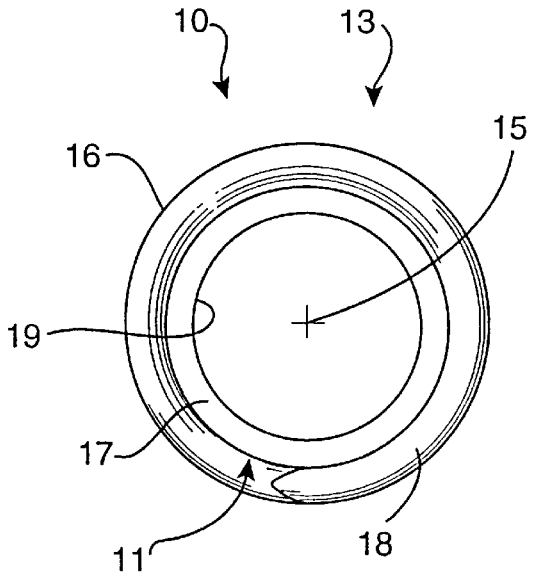
FIG. 3 is an enlarged bottom plan view of an alternative embodiment of the anchoring device of FIG. 1 illustrating an opening into the tubular shaft.

The coiled extension portion 18 extends beyond the distal end of the shaft 11 in substantial axial alignment with the shaft longitudinal axis 15 (FIG. 3). Further, the extension portion extends beyond the shaft lower longitudinal end 17 by an arc length equivalent to about one complete coil. It will be appreciated that the combination of the arc length of the extension portion and the positioning of the tip portion 21 of the extension portion cooperate to assist penetration of the ground while simultaneously resisting substantial uncoiling of the extension portion 18 during rotational mounting in harder soils. Arc lengths of the extension portions of substantially greater than about one coil are more susceptible to uncoiling during penetration movement into the ground which considerably increases penetration difficulty of the anchoring device.

The helical-shaped coils are substantially smaller in diameter than that of the anchoring shaft, and can be integrally formed with the shaft lower end 17. Preferably, however, the threaded portion is welded to the shaft lower end 17 for simple mounting thereto so that during fabrication, the threaded portion may be simply slid over and onto the shaft lower end and welded thereto.

To facilitate rotational penetrating movement of shaft 11 and ground penetration member 13 into the ground, a crank arm 22 (FIG. 1) is included removably mounted to the upper longitudinal end 20 of the shaft 11 in an orientation generally perpendicular to the shaft longitudinal axis. The crank arm 22 may be provided by a generally straight rod or shaft, and is formed to be slidably received in a slot 23 extending transversely through the anchoring device shaft 11 therethrough. Once the crank arm is releasably positioned though shaft slot 23, preferably to a central portion thereof, the anchoring device 10 can be more easily rotated about longitudinal axis 15 in the clockwise direction for penetrating movement into the ground. Crank arm 22 therefor substantially increases leverage by providing a moment arm about the longitudinal axis. Subsequently, the crank arm can be slidably removed from slot 23 to support any type sign or the like.

Figure 4:
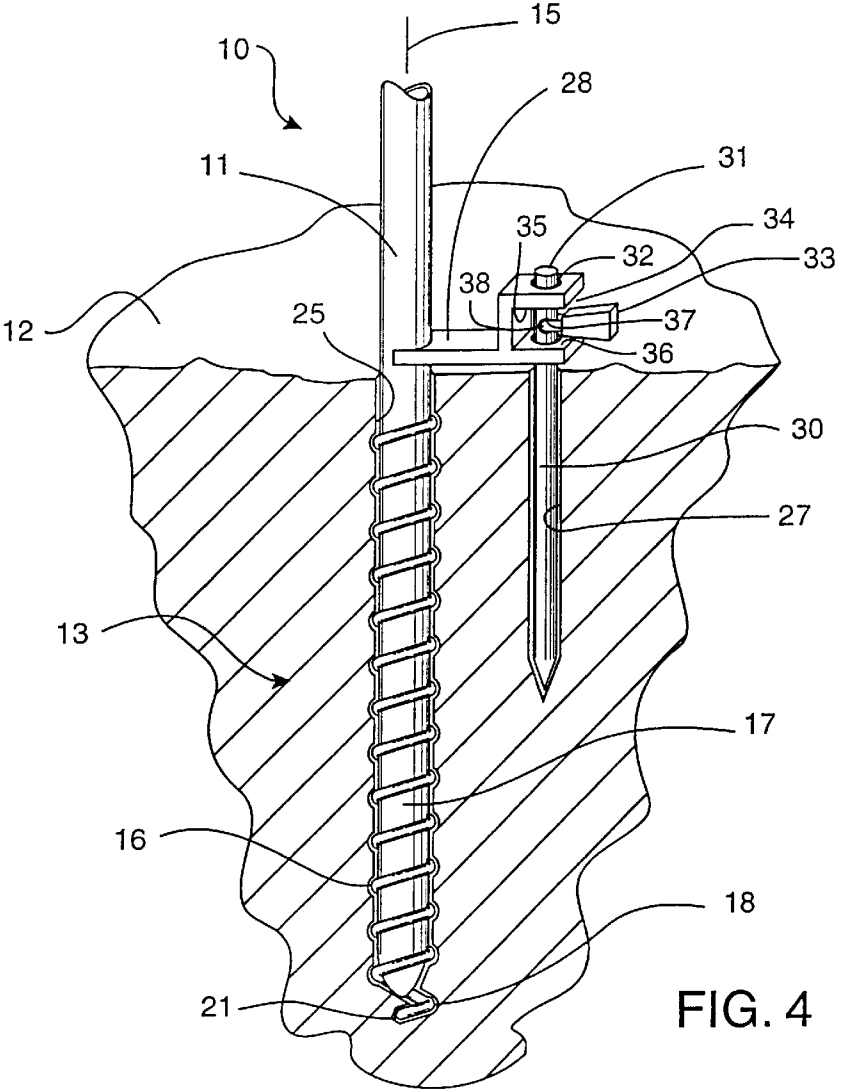
FIG. 4 is a fragmentary, enlarged side perspective view, in partial cross-section, of the anchoring device of FIG. 1 mounted in the ground.

Turning now to FIG. 4, another aspect of the present invention is provided for preventing unauthorized removal of the anchoring device 10 once rotationally mounted in the ground at a first location 25 when rotated about a longitudinal axis 15 of the shaft. The anchoring device 10 further includes a retaining device, generally designated 26, releasably coupled to the shaft which is formed and dimensioned for selective penetration of the ground at a second location 27 spaced-apart from the first location to substantially prevent rotational movement of the shaft 11 about the longitudinal axis 15 for removal thereof from the ground.

Accordingly, the screw-post or anchoring device 10 is capable of being locked to the ground to prevent rotation of the shaft for unauthorized removal thereof from the first location 25. FIG. 4 illustrates that retaining device 26 preferably includes a flange 28 coupled to shaft 11 in a manner extending radially outward therefrom. An elongated ground engaging member 30 is included formed for selective penetration of the ground at the second location 27. This ground engaging member 30 is releasably coupled to and formed to cooperate with flange 28 and to the ground 12 to substantially prevent said rotational movement of the shaft about the longitudinal axis 15 in the opposite second direction.

The engaging member 30 is preferably provided by an elongated pin or rod member having a head portion 31 on one end and a penetrating tip portion 21 on an opposite end thereof. The ground engaging member should be of a sufficient diameter and length to extend into the ground by an amount securing the shaft in the ground. Preferably, for a shaft diameter of about ½ inch to about 1 ½ inch, and preferably ⅞ inch, and the diameter of the engaging member should be preferably between about ¼ inch to about ½ inch.

Flange 28 is preferably provided by a plate-like structure extending substantially perpendicular to the longitudinal axis of shaft 11. This structure is preferably rigidly coupled to shaft by welding or integral molding when anchoring device 10 is composed of a thermoplastic or the like. The flange 28, however, could be pivotally mounted to the shaft 11 enabling articulation of the flange about a horizontal axis relative shaft 11. Further, the flange could be vertically movable relative the longitudinal axis of shaft 11 to accommodate increased or reduced mounting depth in the ground by the penetration member 13. Hence, the flange could be positioned at one of a plurality of selected positions longitudinally along the shaft. This may be provided by a ratchet-type mechanism or the like enabling releasable mounting longitudinally along shaft 11, while preventing rotational movement of the flange about the longitudinal axis.

In the preferred form, as shown in FIG. 4, flange 28 includes an end portion 31 providing a bore 32 extending therethrough which is formed for sliding receipt of the elongated engaging member therein. The engaging member 30 is movable between a ground engaging position (FIG. 4) and the released position (FIG. 2). In the engaging position, the ground engaging member is selectively positioned in the ground through the flange bore 32, at the second location 27. Hence, any rotational movement of shaft 11 about the longitudinal axis thereof is prevented as flange 28 contacts the side wall of engaging member 30. In contrast, in the released position, the ground engaging member 30 is oriented free of contact with the flange 28 which enables rotational movement of the shaft about the longitudinal axis in the second direction.

While bore 32 is preferably provided by a complete bore extending substantially vertically through flange 28, it will be understood that the bore could be provided by any partial bore positioned at an edge of flange 28 formed for sliding receipt of engaging member 30. Further, the bore could extend through any additional structure affixed to flange 28.

In the preferred form, retaining device 26 includes a locking mechanism, generally designated 33, movable between a locked condition and an unlocked condition. In the locked condition (FIG. 4), the engaging member is releasably locked to the flange 28 in the ground engaging position to prevent removal thereof from the second location 27. In the unlocked condition (FIG. 2), the engaging member can be freely released or removed from the bore of flange 28, enabling movement of the engaging member between the engaged and released positions.

End portion 31 preferably includes a horizontally oriented channel 34 extending therethrough defined partially by an upper retaining surface 35 and an opposed lower retaining surface 36. These opposed retaining surfaces 35, 36 cooperate with the lock mechanism 33, when in the locked condition, to prevent movement of the engaging member 30 from the ground engaging positioned to the released position.

In the preferred embodiment, the lock mechanism 33 is provided by a pad lock or the like. Lock mechanism, however, may be provided by any device capable of releasably locking the engaging member to the flange. Engaging member 30 includes an aperture 37 extending transversely therethrough formed and dimensioned for removable receipt of the U-bolt 38 of locking mechanism. Accordingly, when engaging member 30 is in the ground engaging condition where the engaging member extends through flange bore 32 and is inserted into the ground at the second penetration, the aperture is positioned between the upper and lower retaining surfaces 35, 36 in the square channel 34. In this arrangement, the U-bolt of the lock mechanism 33 can be positioned through the aperture 37 to move the retaining device 26 to the locked position. The lock mechanism 33 will prevent unauthorized removal of the engaging member as the U-bolt 38 of lock mechanism will contact either the upper retaining surface 35 or the lower retaining surface 36 of the flange 28. Since the lock mechanism 33 will not be capable of passing through bore 32, when coupled to engaging member 30, the same will be prevented from moving to the released condition until the lock mechanism is removed.

Figure 5:
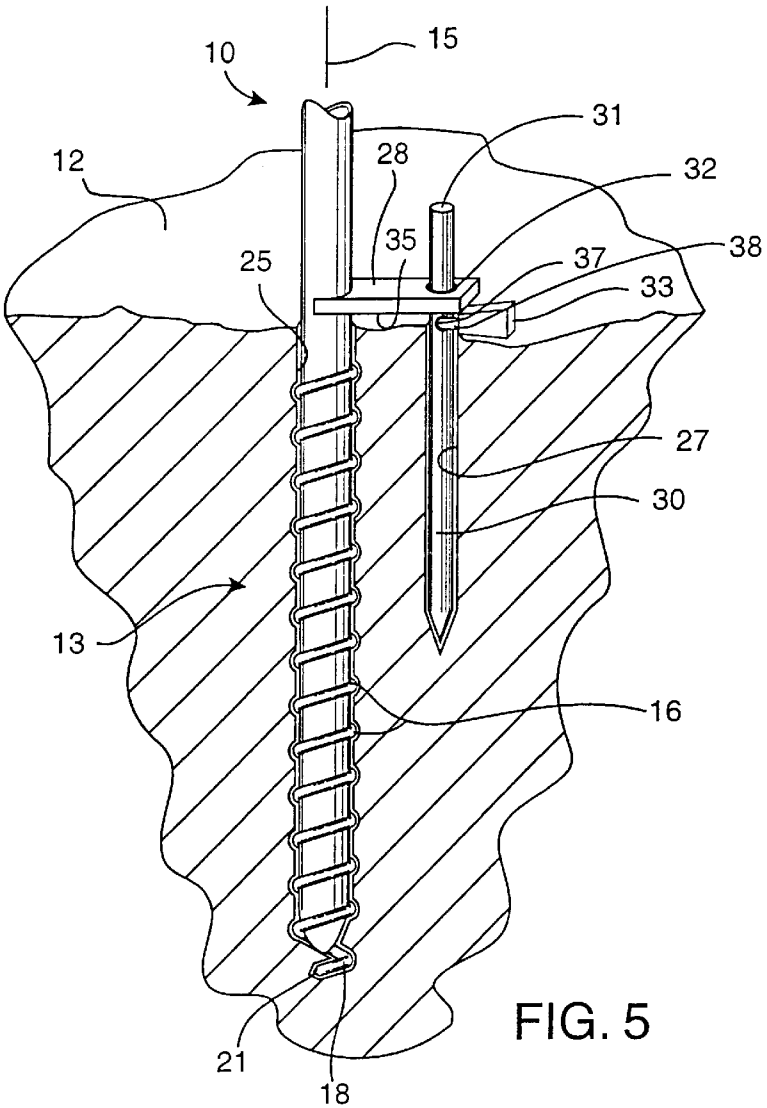
FIG. 5 is a fragmentary, enlarged side perspective view of an alternative embodiment of the anchoring device of FIG. 1.

Alternatively, flange 28 may be provided by a plate having a bore extending therethrough. As shown in FIG. 5, the flange 28 would not include a channel 34, and hence, would only provide an upper retaining surface 35 for engagement with lock mechanism 33. Once the engaging member is positioned through flange bore 32, and the engaging member aperture 37 is positioned below the upper retaining surface, the lock mechanism 33 may be placed in the locked position between the ground 12 and the upper retaining surface 35. Unauthorized removal of engaging member, and thus, anchoring device 10, would be prevented as the U-bolt of lock mechanism 33 contacts the upper retaining surface 35.

Figure 6:
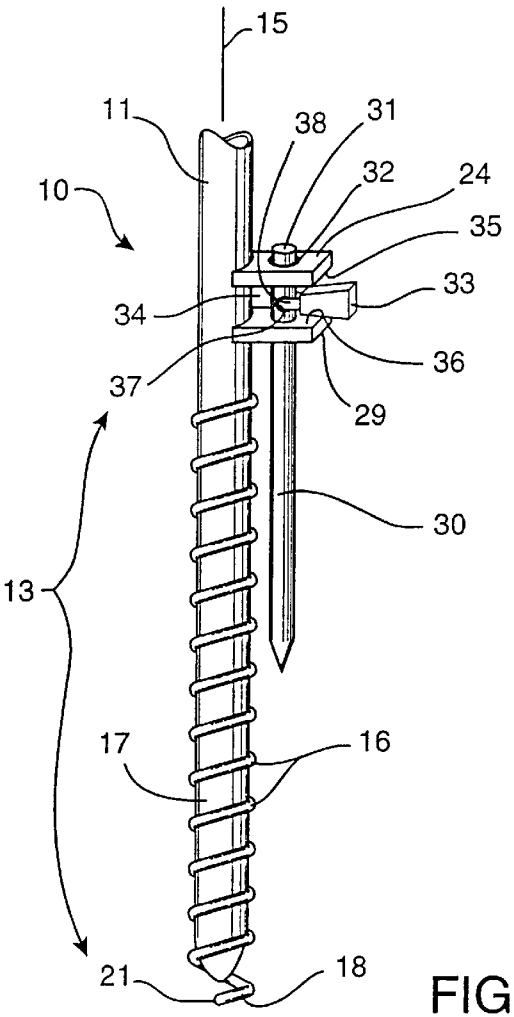
FIG. 6 is a fragmentary, enlarged side perspective view of another alternative embodiment of the anchoring device of FIG. 1.

In another alternative embodiment as shown in FIG. 6, an upper flange portion 24 and a lower flange portion 29 of flange 28 may be mounted more directly to the shaft 11. Upper flange 24 would provide upper retaining surface 35, while lower flange 29 would provide lower retaining surface 36. This embodiment may be more advantageous when mounting space is more limited and the lateral spacing between the first penetration and the second penetration is relatively small.

In operation, as shown in FIG. 1, the anchoring device 10 is adapted to be readily screwed and locked into the hard and soft soils before receiving an accessory such as but not limited to real-estate sign, rental sign, temporary or permanent fence post, and tree, garden, landscape, volleyball, or badminton accessories. The device 10 is inserted and locked into the ground by first positioning the crank arm 22 through slot 23 of the shaft 11. The crank arm 22 is then grasped in each hand and then rotated clockwise while simultaneously pushing downwardly along the direction of longitudinal axis 15 to initially drive penetration member 13 into the ground. Once the extension portion extends into the ground in a corkscrew type manner, continued rotation of the anchoring device 10 causes progressively deeper penetration of the penetration member until threaded portion 16 extends into the ground 12 until sufficiently anchored into the ground. This results in a significant anchoring effect.

As shown in FIG. 2, an engaging member 30 is ready to be inserted through the flange bore 32 of retaining device 26. The engaging member 30 is then driven into the ground until the aperture 37 is exposed between the upper and lower retaining surfaces 35, 36 of the channel 34. The U-bolt 38 of lock mechanism 33 is inserted through aperture 37 in engaging member 30. The lock mechanism 33 is then housed between the upper and lower retaining surfaces of channel 34 of flange 28. The combination of the anchoring device 10 and retaining device 26 provide a significantly stable arrangement capable of being screwed and locked into the ground. Once in the ground, the anchoring device 10 is ready to support or accept an accessory to the upper longitudinal end 20.

The anchoring device 10 is easily removed from the ground by first, unlocking and removing lock mechanism 33 from the engaging member 30 (i.e., moving the lock mechanism from the locked position to the unlocked position). This enables the engaging member 30 to be removed from bore 32 of flange 28 (i.e., from the engaged position to the released position). The crank arm 22 can then be rotated counter-clockwise until the device is fully unscrewed from the earth.

What is claimed is:

1. An anchoring device for anchoring a shaft in substantially hard ground comprising:

an elongated shaft having a lower end adapted to facilitate rotational penetration of the substantially hard ground at a first location of penetration thereof when rotated about a longitudinal axis of the shaft; and a retaining device including a retaining member coupled to the shaft and an elongated ground engaging member cooperating with said retaining member to position the ground engaging member a substantially fixed distance from the shaft, said ground engaging member being formed and dimensioned for selective penetration of the ground at a second location spaced-apart at said substantially fixed distance from the first location to substantially prevent rotational movement of said shaft about the longitudinal axis for rotational removal thereof from the ground.

2. The anchoring device according to claim 1 wherein, said retaining member includes a flange rigidly mounted to said shaft and extending radially outward therefrom, and said engaging member releasably coupled to and cooperating with said flange at the substantially fixed distance from the shaft to substantially prevent said rotational movement.

3. The anchoring device according to claim 2 wherein, said retaining device further includes a locking mechanism movable between an unlocked condition, releasing said engaging member from said flange to enable removal thereof from said second location, and a locked condition, releasably locking said engaging member to said flange to prevent removal thereof from said second location.

4. The anchoring device according to claim 3 wherein, said flange includes an end portion defining a bore formed for sliding receipt of said engaging member therethrough between a released position, permitting said rotational movement of said shaft at the first location, and a ground engaging position, engaging the ground at said second location and contacting said end portion to substantially prevent said rotational movement of said shaft.

5. The anchoring device according to claim 4 wherein, said flange includes a retaining surface cooperating with said locking mechanism in the locked condition to prevent movement of said engaging member to said released position.

6. The anchoring device according to claim 5 wherein, said bore extends from a top surface of said flange to said retaining surface, and said engaging member includes an aperture extending therethrough generally transverse to a longitudinal axis of the engaging member, and formed for sliding receipt of a post of said locking mechanism therethrough for retaining contact with the retaining surface, when in said locked condition, to prevent movement of said engaging member from said engaging position to said released position.

7. The anchoring device according to claim 6 wherein, said flange extends outwardly from said shaft generally perpendicular to the shaft longitudinal axis.

8. The anchoring device according to claim 7 wherein, said bore extends through said flange generally parallel to said shaft longitudinal axis.

9. The anchoring device according to claim 5 wherein, said bore of said flange extends through a cavity therein defined by an upper retaining surface and a lower retaining surface of the flange, and said engaging member includes an aperture extending therethrough generally transverse to a longitudinal axis of the engaging member, and formed for sliding receipt of a post of said locking mechanism therethrough for positioning and retaining contact thereof between and with the upper and lower retaining surfaces, when in said locked condition, to prevent movement of said engaging member from said ground engaging position to said released position.

10. The anchoring device according to claim 9 wherein, said locking mechanism is a pad lock.

11. The anchoring device according to claim 10 wherein, said engaging member is a penetrating stake.

12. The anchoring device according to claim 2 wherein, said flange includes an end portion defining a bore formed for sliding receipt of said engaging member therethrough between a released position, permitting said rotational movement of said shaft at the first location, and a ground engaging position, engaging the ground at said second location and contacting said end portion to substantially prevent said rotational movement of said shaft.

13. The anchoring device according to claim 1 wherein, said shaft includes an elongated helical-shaped member extending from the shaft lower end and spiraling about the shaft longitudinal axis, said helical-shaped member having a diameter substantially smaller than the diameter of the shaft.

14. The anchoring device according to claim 13 wherein, said helical-shaped member further extending from the shaft lower end to form a threaded lower end which penetrates the ground.

15. The anchoring device according to claim 1 further including:

a display member supported by said shaft.

16. The anchoring device according to claim 1 wherein, said retaining member includes a flange extending radially outward from said shaft, and adapted for releasable mounting to said shaft between a first condition, enabling longitudinal positioning at a selected one of a plurality of positions longitudinally along the shaft, and a second condition, fixedly mounted to said shaft in a substantially rigid manner, and said elongated ground engaging member releasably coupled to and cooperating with said flange at the substantially fixed distance from the shaft to substantially prevent said rotational movement.

17. The anchoring device according to claim 1 wherein, said retaining device further includes a locking mechanism movable between a locked condition, releasably locking said retaining device to said shaft while positioned in said selective penetration to prevent removal thereof from said second location, and an unlocked condition, releasing said retaining device from said shaft to enable removal thereof from said second location.

18. The anchoring device according to claim 2 wherein, said flange extends radially outward from said shaft at about 90° from the shaft longitudinal axis.

19. The anchoring device according to claim 1 wherein, said lower end of the elongated shaft includes a threaded portion configured to facilitate rotational penetration of the ground.

20. An anchoring device for anchoring a shaft in substantially hard ground comprising:

an elongated shaft;

a ground penetration member including a plurality of helical-shaped coils having a coiled threaded portion mounted to a lower end of the shaft and spiraling about the shaft longitudinal axis, and a coiled extension portion extending longitudinally beyond the shaft lower end in a coiled manner, said extension portion extending from the coiled threaded portion and positioned in substantial axial alignment with the shaft longitudinal axis to facilitate penetration of the ground and being of at most about one coil to resist substantial uncoiling of the coiled extension portion during penetrating movement into the substantially hard ground, said helical-shaped coils having a diameter substantially smaller than the diameter of the shaft and each coil having a substantially constant coil diameter for both said threaded portion and said extension portion; and a retaining device releasably coupled to the shaft, and formed and dimensioned for selective penetration of the ground at a second location spaced-apart from a first location of the penetration of said elongated shaft to substantially prevent rotational movement of said shaft in an opposite second direction about the longitudinal axis for rotational removal thereof from the ground.

21. The anchoring device according to claim 20 wherein, said ground penetrating member is integrally formed with said shaft.

22. The anchoring device according to claim 20 wherein, said retaining device includes a flange mounted to said shaft and extending radially outward therefrom, and an elongated ground engaging member formed for said selective penetration of the ground at the second location, said engaging member releasably coupled to and cooperating with said flange to substantially prevent said rotational movement in the opposite second direction.

23. The anchoring device according to claim 22 wherein, said retaining device further includes a locking mechanism movable between an unlocked condition, releasing said engaging member from said flange to enable removal thereof from said second location, and a locked condition, releasably locking said engaging member to said flange to prevent removal thereof from said second location.

24. The anchoring device according to claim 23 wherein, said flange includes an end portion defining a bore formed for sliding receipt of said engaging member therethrough between a released position, permitting said rotational movement of said shaft at the first location, and a ground engaging position, engaging the ground at said second location and contacting said end portion to substantially prevent said rotational movement of said shaft in the opposite second direction.

25. The anchoring device according to claim 24 wherein, said flange includes a retaining surface cooperating with said locking mechanism in the locked condition to prevent movement of said engaging member to said released position.

26. The anchoring device according to claim 25 wherein, said bore extends from a top surface of said flange to said retaining surface, and said engaging member includes an aperture extending therethrough generally transverse to a longitudinal axis of the engaging member, and formed for sliding receipt of a post of said locking mechanism therethrough for retaining contact with the retaining surface, when in said locked condition, to prevent movement of said engaging member from said engaging position to said released position.

27. The anchoring device according to claim 24 wherein, said bore of said flange extends through a cavity therein defined by an upper retaining surface and a lower retaining surface of the flange, and said engaging member includes an aperture extending therethrough generally transverse to a longitudinal axis of the engaging member, and formed for sliding receipt of a post of said locking mechanism therethrough for positioning and retaining contact thereof between and with the upper and lower retaining surfaces, when in said locked condition, to prevent movement of said engaging member from said ground engaging position to said released position.

28. An anchoring device for anchoring a shaft in the ground comprising:

an elongated shaft having a lower end adapted for rotationally penetrating the ground at a first location of penetration thereof when rotated about a longitudinal axis of the shaft; and a retaining device including a retaining member coupled to the shaft and a ground engaging member releasably coupled to the retaining member, the ground engaging member formed and dimensioned for selective penetration of the ground at a second location spaced-apart from the first location to substantially prevent rotational movement of said shaft about the longitudinal axis for rotational removal thereof from the ground; and a locking mechanism movable between a locked condition, releasably locking said ground engaging member to said shaft while positioned in said selective penetration to prevent removal thereof from said second location, and an unlocked condition, releasing said ground engaging member from said shaft to enable removal thereof from said second location.

29. The anchoring device according to claim 28 wherein, said retaining member includes a flange coupled to said shaft and extending radially outward therefrom, said engaging member releasably coupled to and cooperating with said flange to substantially prevent said rotational movement.

30. A The anchoring device according to claim 29 wherein, said flange includes an end portion defining a bore formed for sliding receipt of said engaging member therethrough between a released position, permitting said rotational movement of said shaft at the first location, and a ground engaging position, engaging the ground at said second location and contacting said end portion to substantially prevent said rotational movement of said shaft.

31. The anchoring device according to claims 30 wherein, said flange includes a retaining surface cooperating with said locking mechanism in the locked condition to prevent movement of said engaging member to said released position.

32. The anchoring device according to claim 29 wherein, said flange extends outwardly from said shaft generally perpendicular to the shaft longitudinal axis.

33. The anchoring device according to claim 28 wherein, said shaft includes an elongated helical-shaped member mounted to the shaft lower end and spiraling about the shaft longitudinal axis, said helical-shaped member having a diameter substantially smaller than the diameter of the shaft.

34. The anchoring device according to claim 33 wherein, said helical-shaped member further extending from the shaft lower end to form a threaded lower end which penetrates the ground.

35. The anchoring device according to claim 29 wherein, said flange is movably mounted to shaft at one of a plurality of positions longitudinally along the shaft.

36. An anchoring device for anchoring a shaft in the ground comprising:

an elongated shaft having a lower end adapted for rotationally penetrating the ground at a first location of penetration thereof when rotated about a longitudinal axis of the shaft; and a retaining device including a flange member coupled to said shaft and extending radially outward therefrom at about 90° from the shaft longitudinal axis, and an elongated ground engaging member formed for selective penetration of the ground at a second location spaced-apart from the first location, said engaging member releasably coupled to and cooperating with said flange member to position said second location a substantially fixed distance from said first location and to substantially prevent rotational movement of said shaft about the longitudinal axis for rotational removal thereof from the ground.

37. The anchoring device according to claim 36 wherein, the lower end of said shaft is tubular, and defines an opening at a distal end thereof for receipt of soil therein during penetration.

38. The anchoring device according to claim 36 wherein, said flange includes an end portion defining a bore formed for sliding receipt of said engaging member therethrough between a released position, permitting said rotational movement of said shaft at the first location, and a ground engaging position, engaging the ground at said second location and contacting said end portion to substantially prevent said rotational movement of said shaft.

39. The anchoring device according to claim 36 wherein, said shaft includes an elongated helical-shaped member having a coiled threaded portion mounted to a lower end of the shaft and spiraling about the shaft longitudinal axis, and a coiled extension portion extending longitudinally beyond the shaft lower end in a coiled manner, said helical-shaped member having a diameter substantially smaller than the diameter of the shaft and having a substantially constant coil diameter for both said threaded portion and said extension portion.

40. The anchoring device according to claim 39 wherein, the coil length of said helical-shaped member extending beyond the lower end of said shaft is at most about one coil.

41. The anchoring device according to claim 36 wherein, said flange is adapted for releasable mounting to said shaft between a first condition, enabling longitudinal positioning at a selected one of a plurality of positions longitudinally along the shaft, and a second conditioning, fixedly mounted to said shaft in a substantially rigid manner.

42. An anchoring device for anchoring a shaft in substantially hard ground comprising:

an elongated shaft having a lower end adapted to facilitate rotational penetration of the substantially hard ground at a first location of penetration thereof when rotated about a longitudinal axis of the shaft, said lower end further being tubular and defining an opening at a distal end thereof for receipt of soil therein during said penetration; and a retaining device including a retaining member coupled to the shaft and a ground engaging member cooperating with the retaining member to position the ground engaging member at a substantially fixed distance from the shaft, and formed and dimensioned for selective penetration of the ground at a second location spaced-apart from the first location to substantially prevent rotational movement of said shaft about the longitudinal axis for rotational removal thereof from the ground.

43. The anchoring device according to claim 42 wherein, said retaining member includes a flange mounted to said shaft and extending radially outward therefrom, said engaging member releasably coupled to and cooperating with said flange at the substantially fixed distance from the shaft to substantially prevent said rotational movement.

44. The anchoring device according to claim 42 wherein, said retaining member includes a flange extending radially outward from said shaft, and adapted for releasable mounting to said shaft between a first condition, enabling longitudinal positioning at a selected one of a plurality of positions longitudinally along the shaft, and a second condition, fixedly mounted to said shaft in a substantially rigid manner, and the elongated ground engaging member releasably coupled to and cooperating with said flange at the substantially fixed distance from the shaft to substantially prevent said rotational movement.

45. The anchoring device according to claim 44 wherein, said flange includes an end portion defining a bore formed for sliding receipt of said engaging member therethrough between a released position, permitting said rotational movement of said shaft at the first location, and a ground engaging position, engaging the ground at said second location and contacting said end portion to substantially prevent said rotational movement of said shaft.

46. The anchoring device according to claim 45 wherein, said flange extends outwardly from said shaft generally perpendicular to the shaft longitudinal axis.

47. The anchoring device according to claim 43 wherein, said shaft includes an elongated helical-shaped member mounted to the lower end of the shaft and spiraling about the shaft longitudinal axis, said helical-shaped member having a diameter substantially smaller than the diameter of the shaft.

48. The anchoring device according to claim 47 wherein, said helical-shaped member further extending from the lower end to form a threaded lower end which penetrates the ground.

49. The anchoring device according to claim 48 wherein, the coil length of said helical-shaped member extending from the lower end of said shaft is at most about one coil.

50. A method of anchoring a screw post device in the ground comprising the steps of:

rotationally penetrating a lower end of an elongated shaft into the ground at a first location, said lower end being adapted to facilitate rotational penetration about a longitudinal axis thereof; and releasably coupling to the shaft a ground engaging member which cooperates with a retaining member to position the ground engaging member a substantially fixed distance from the shaft; and substantially preventing rotational movement of said shaft about the longitudinal axis for rotational removal thereof from the ground by penetrating the ground engaging member into the ground at a second location spaced-apart from the first location while releasably coupled to the shaft at said substantially fixed distance.

51. The method of claim 50 wherein, said retaining member includes a flange coupled to said shaft and extending radially outward therefrom, said engaging member adapted to be releasably coupled to and cooperate with said flange at the substantially fixed distance from the shaft to substantially prevent said rotational movement.

52. The method of claim 50 further including the step of:

before the preventing step, positioning the retaining member at a selected one of a plurality of positions longitudinally along the shaft; and fixedly mounting the retaining member to the shaft at the selected one position.

53. The anchoring device according to claim 20 wherein, the lower end of said shaft is tubular, and defines an opening at a distal end thereof for receipt of soil therein during penetration.

* * * * *